US008502754B2

(12) United States Patent
Lin

(10) Patent No.: US 8,502,754 B2
(45) Date of Patent: Aug. 6, 2013

(54) DRIVING CIRCUIT OF CURRENT-DRIVEN ACTIVE MATRIX ORGANIC LIGHT EMITTING DIODE PIXEL

(75) Inventor: Chiao-Ju Lin, Taichung (TW)

(73) Assignee: Au Optronics Corporation, Hsinchu (TW)

( * ) Notice: Subject to any disclaimer, the term of this patent is extended or adjusted under 35 U.S.C. 154(b) by 1647 days.

(21) Appl. No.: 10/708,198

(22) Filed: Feb. 16, 2004

(65) Prior Publication Data

US 2004/0178407 A1 Sep. 16, 2004

(30) Foreign Application Priority Data

Mar. 12, 2003 (TW) ..... 92105318 A

(51) Int. Cl.
*G09G 3/32* (2006.01)

(52) U.S. Cl.
USPC ..... 345/82; 345/76; 345/90

(58) Field of Classification Search
USPC ..... 345/55, 63, 67–69, 76–83, 90–92, 345/94–96, 98, 99, 204, 205, 208, 210, 690; 315/169.1, 169.3; 257/88
See application file for complete search history.

(56) References Cited

U.S. PATENT DOCUMENTS

| | | | | |
|---|---|---|---|---|
| 5,723,950 | A * | 3/1998 | Wei et al. | 315/169.3 |
| 6,229,506 | B1 * | 5/2001 | Dawson et al. | 345/82 |
| 6,229,508 | B1 * | 5/2001 | Kane | 345/82 |
| 6,323,631 | B1 * | 11/2001 | Juang | 323/315 |
| 6,366,116 | B1 * | 4/2002 | Juang | 326/37 |
| 6,400,349 | B1 * | 6/2002 | Nagumo | 345/82 |
| 6,400,448 | B1 * | 6/2002 | Sugawara et al. | 356/5.01 |
| 6,583,775 | B1 * | 6/2003 | Sekiya et al. | 345/76 |
| 6,859,193 | B1 * | 2/2005 | Yumoto | 345/82 |
| 6,861,810 | B2 * | 3/2005 | Rutherford | 315/169.3 |
| 7,046,240 | B2 * | 5/2006 | Kimura | 345/212 |
| 7,057,589 | B2 * | 6/2006 | Shin et al. | 345/82 |
| 7,106,281 | B2 * | 9/2006 | Kim et al. | 345/76 |
| 7,154,454 | B2 * | 12/2006 | Okabe et al. | 345/76 |
| 7,170,094 | B2 * | 1/2007 | Yamazaki et al. | 345/102 |
| 7,173,612 | B2 * | 2/2007 | Nanno et al. | 345/211 |
| 7,184,034 | B2 * | 2/2007 | Kimura | 345/205 |
| 7,199,768 | B2 * | 4/2007 | Ono et al. | 345/76 |

FOREIGN PATENT DOCUMENTS

WO WO 0106484 A1 * 1/2001

* cited by examiner

*Primary Examiner* — Amare Mengistu
*Assistant Examiner* — Premal Patel
(74) *Attorney, Agent, or Firm* — Jianq Chyun IP Office

(57) ABSTRACT

A method and a driving circuit for driving a current-driven active matrix organic light emitting diode (AMOLED) pixel are provided. A driving power source is used to pre-charge the capacitor before a current source charges/discharges a capacitor connected to a driving thin film transistor of the pixel. Therefore, an insufficient brightness problem during displaying a low gray can be solved.

6 Claims, 4 Drawing Sheets

DRIVING CIRCUIT OF CURRENT-DRIVEN ACTIVE MATRIX ORGANIC LIGHT EMITTING DIODE PIXEL

CROSS REFERENCE TO RELATED APPLICATIONS

This application claims the priority benefit of Taiwan application serial no. 92105318, filed on Mar. 12, 2003.

BACKGROUND OF INVENTION

1. Field of the Invention

This invention relates in general to a driving circuit of an active matrix organic light emitting diode (AMOLED) pixel, and more particularly, to a driving circuit of a current-driven active matrix organic light emitting diode pixel and a driving method thereof.

2. Description of Related Art

As information technology develops continuously, new models of various information devices, such as computers, mobile phones, personal digital assistants (PDA) and digital cameras, keep being produced. Among these information devices, a display always plays a very important part, and flat panel displays are getting more popular then ever because of their thin, light, compact and power saving characteristics.

Among the variety of flat panel displays, an AMOLED display is very suitable for devices with a small size display, such as an electronic clock, a mobile phone, a PDA, or a digital camera, because of its wide view angle, good color contrast effect, fast response time, and low cost, etc.

FIG. 1 shows schematically a pixel of a conventional voltage-driven AMOLED. In FIG. 1, the AMOLED pixel comprises a switching thin film transistor 110, a driving thin film transistor 120, a capacitor 130, and an OLED 140. A gray scale to be displayed is determined by a voltage on a data line. When a voltage on the scan line is applied to a gate of the switching thin film transistor 110 (i.e., the pixel is scanned), the switching thin film transistor 110 is thus turned on, so that the voltage on the data line is transmitted to a gate of the driving thin film transistor 120. The gate voltage Vg of the driving thin film transistor 120 drives a current to flow through the OLED 140 to display. However, threshold voltages and mobilities for driving thin film transistors 120 of different pixels are different from each other since the manufacturing process is not uniform. As a result, even though the same gray scale voltage is provided, the currents flown through the OLEDs 140 will be different, causing a displayed image or screen to be not uniform.

FIG. 2 shows schematically a pixel of a conventional current-driven AMOLED. In FIG. 2, the AMOLED pixel comprises a first switch 210, a second switch 220, a third switch 230, an OLED 240, a driving thin film transistor 250 and a capacitor 260. In operation, the second switch 220 and the third switch 230 are first turned on, so that a current provided by a current source flows through the driving thin film transistor 250 to charge the capacitor 260. At this time, a gate voltage is stored in the capacitor 260. Then, the second switch 220 and the third switch 230 are turned off and the first switch 210 is turned on, so as to control the AMOLED pixel to illuminate.

The gray scale of the current-driven AMOLED pixel is determined by a magnitude of the current provided by the current source, and therefore, the gray scale will not be affected by the threshold voltages and the mobilities of the driving thin film transistors 250 of different pixels to cause an unevenness of the displayed image or screen. However, when the current-driven AMOLED prepares to display a low gray scale, because the current of the current source is small, the pixels are easily affected by parasitic resistors of the display panel and a delay effect caused by capacitors, so that the gate capacitor in the pixel cannot be charged within a predetermined scanning time. Therefore, a wrong gate voltage is stored to cause an insufficient brightness when the pixel is driven to illuminate.

SUMMARY OF INVENTION

According to the foregoing description, an object of this invention is to provide a driving circuit of a current-driven AMOLED pixel and a driving method thereof, which is able to pre-charge the capacitor with a driving power source so as to improve an insufficient brightness problem while displaying a low gray scale.

According to the object(s) mentioned above, the present invention provides a driving circuit of a current-driven active matrix organic light emitting diode (AMOLED) pixel. The driving circuit comprises an AMOLED pixel and a pre-charge switch. The AMOLED pixel is connected to a current source, and the current source is used to charge or discharge a capacitor that is connected to a gate of a driving thin film transistor. A gray scale of the AMOLED pixel is determined by a magnitude of a current provided by the current source. The pre-charge switch is connected to the gate of the driving thin film transistor and a driving power source, and is used for controlling the driving power source to pre-charge the capacitor before the current source charges or discharges the capacitor.

According to one embodiment of the present invention, the driving thin film transistor can be an N-channel thin film transistor, and the AMOLED pixel can further comprise: an organic light emitting diode (OLED), having an anode and a cathode, wherein the anode is connected to a positive power source; a first switch, with one end connected to the cathode of the OLED and another end connected to a drain of the driving thin film transistor; a second switch, with one end connected to the current source and another end connected to the drain of the driving thin film transistor; and a third switch, with one end connected to the drain of the driving thin film transistor and another end connected to the gate of the driving thin film transistor and one end of the capacitor, and wherein the other end of the capacitor is connected to a negative power source.

According to another embodiment of the present invention, the driving thin film transistor can be a P-channel thin film transistor, and the AMOLED pixel can further comprise: an organic light emitting diode (OLED), having an anode and a cathode, wherein the anode is connected to a negative power source; a first switch, with one end connected to the anode of the OLED and another end connected to a drain of the driving thin film transistor; a second switch, with one end connected to the current source and another end connected to the drain of the driving thin film transistor; and a third switch, with one end connected to the drain of the driving thin film transistor and another end connected to the gate of the driving thin film transistor and one end of the capacitor, and wherein the other end of the capacitor is connected to a positive power source.

In the aforementioned driving circuit, the first, the second, the third switches and the pre-charge switch can be N-channel or P-channel thin film transistors. In addition, the driving power source can use the above positive or negative power source. Alternatively, the driving power source can be also a driving power source capable of pre-charging the capacitor to a voltage that is close to a threshold voltage of the thin film transistor.

Furthermore, in order to improve the threshold voltage of the driving thin film transistor drifting with the operation time, a driving power source with different voltages can be used. Namely, a positive voltage level, which can pre-charge the capacitor to a voltage close to the threshold voltage of the driving thin film transistor, is used during the pre-charge stage. Alternatively, a negative voltage level, which is opposite to the pre-charge polarity, is used during other than the pre-charge stage, so as to eject charges trapped within a gate insulating layer of the driving thin film transistor.

The present invention further provides a method for driving a current-driven active matrix organic light emitting diode (AMOLED) pixel, wherein an AMOLED pixel is connected to a current source and a driving power source for charging or discharging a capacitor connected to a gate of a driving thin film transistor of the AMOLED pixel. The method comprises steps of: pre-charging the capacitor by using the driving power source; adjusting a gray-scale charging voltage of the capacitor by using the current source; and stopping charging or discharging the capacitor through the current source to control the AMOLED pixel to enter an illumination stage.

In the above driving method, the capacitor can be pre-charged to a voltage that is close to a threshold voltage of the thin film transistor. Alternatively, a driving power source with two different voltage levels can be used.

As described above, according to the method and the driving circuit for driving the current-driven active matrix organic light emitting diode (AMOLED) pixel, the driving power source is used to pre-charge the capacitor before the current source charges or discharges the capacitor, so as to solve an insufficient brightness problem of displaying a low gray, which is caused by delay effects due to existence of parasitic capacitors, resistors, etc.

BRIEF DESCRIPTION OF DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings.

DETAILED DESCRIPTION

Figure 1:
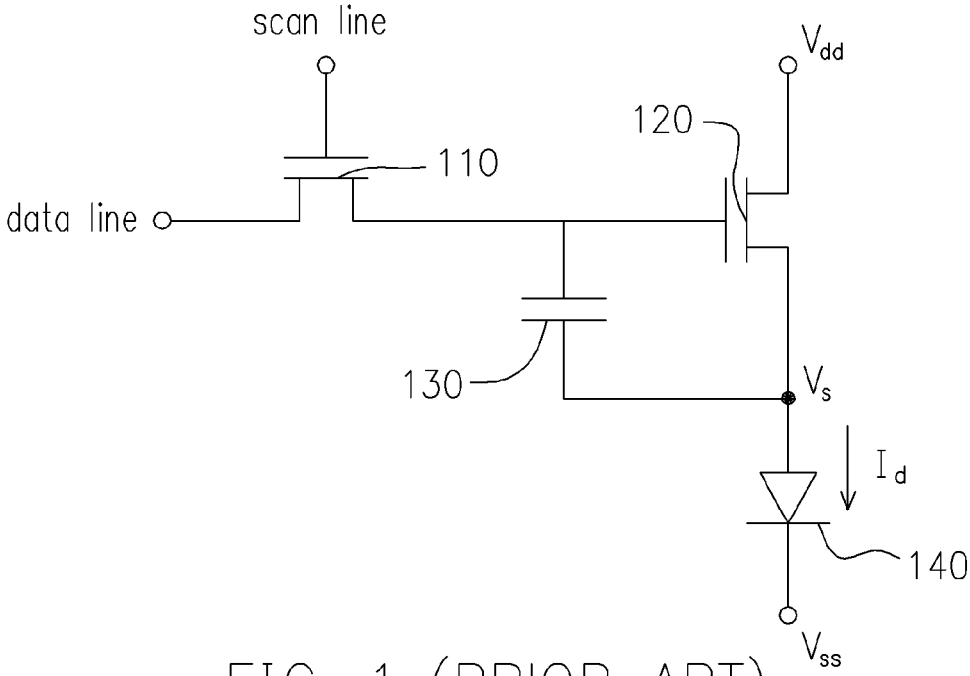
FIG. 1 (PRIOR ART)
FIG. 1 shows schematically a pixel of a conventional voltage-driven AMOLED.
Figure 2:
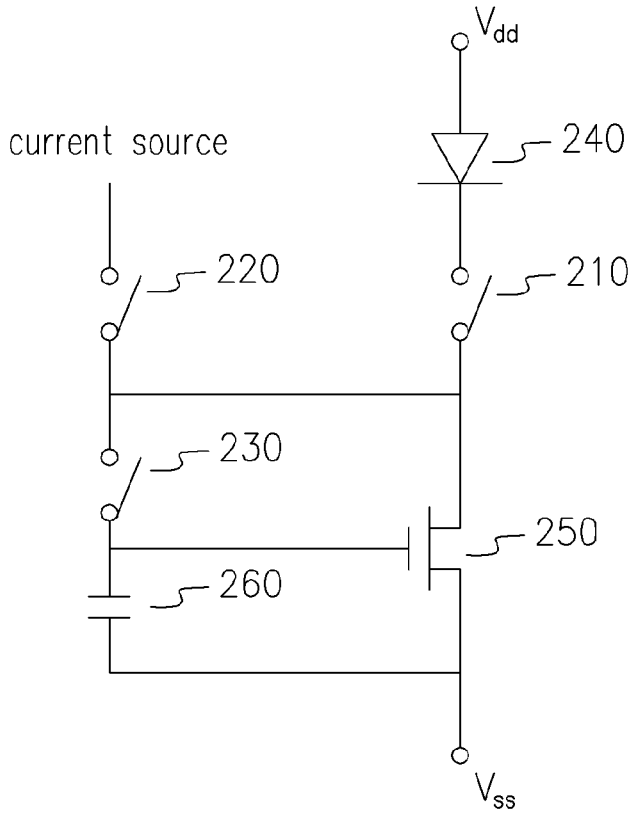
FIG. 2 (PRIOR ART)
FIG. 2 shows schematically a pixel of a conventional current-driven AMOLED.
Figure 3:
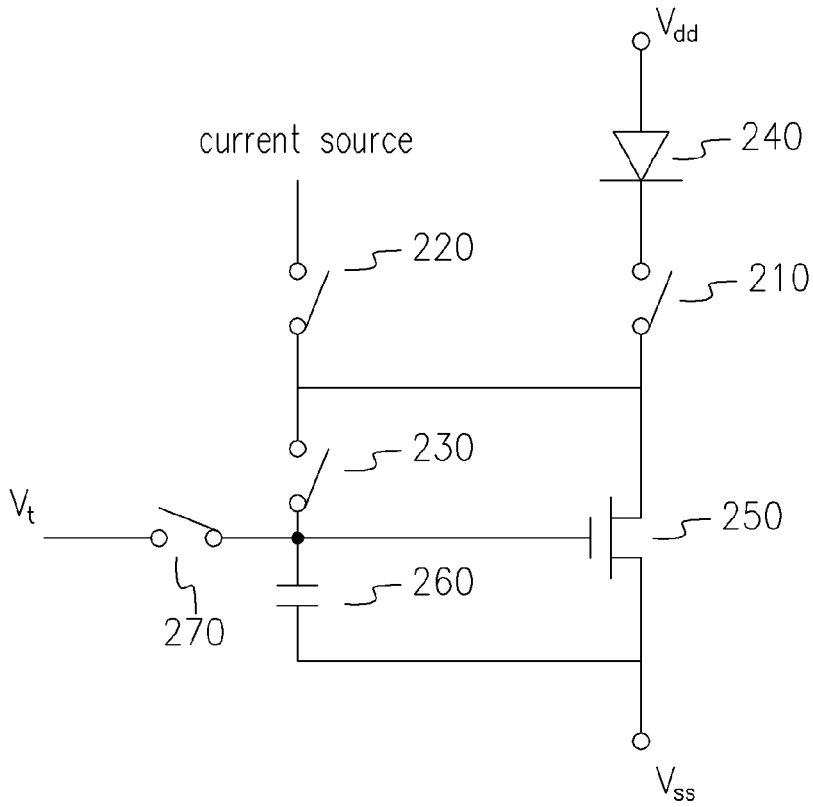
FIG. 3 shows an exemplary driving circuit diagram of a current-driven AMOLED pixel according to the first embodiment of the present invention.

FIG. 3 shows an exemplary driving circuit of a current-driven AMOLED pixel according to the first embodiment of the present invention. In FIG. 3, in addition to the elements of the driving circuit shown in FIG. 2, the driving circuit of the present invention further comprises a driving power source Vt and a pre-charge switch 270.

Figure 5:
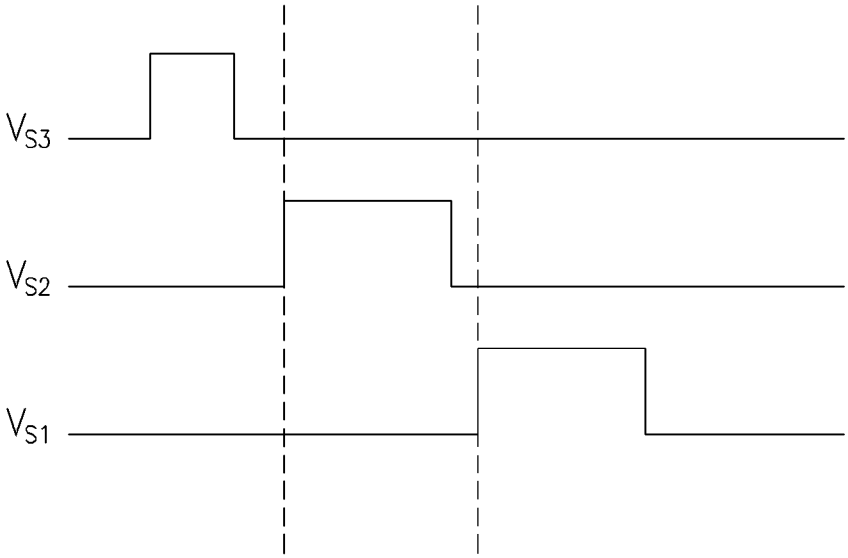
FIG. 5 is a timing diagram of control signals of switches in FIG. 4.

The operation of the driving circuit of the first embodiment is described as follows. The pre-charge switch 270 is first turned on by the control signal $V_{S3}$ as shown in FIG. 5, so that the driving power source Vt pre-charges the capacitor 260 to a pre-charge voltage level before the current source is able to charge or discharge the capacitor 260. Preferably, the pre-charge voltage level is close to a level of the threshold voltage of the driving thin film transistor 250. In this way, when the current source charges or discharges the capacitor 260, a voltage across the capacitor 260 can be fast stabilized to a driving voltage level corresponding to a gray-scale current of the current source. If the number of wires and power sources of the driving circuit are required to be reduced, a positive power source Vdd of the driving circuit can be used as the driving power source Vt to pre-charge the capacitor 260 to the pre-charge voltage level.

After the pre-charge a driving voltage adjustment stage is proceeded. At this time, the pre-charge switch 270 is turned off by the control signal $V_{S3}$, and the second switch 220 and the third switch 230 are turned on by the control signal $V_{S2}$ as shown in FIG. 5, so that the voltage across the capacitor 260 can be fast adjusted to a driving voltage level corresponding to a gray scale current of the current source. Namely, when the voltage across the capacitor 260 is higher than the driving voltage level corresponding to the gray scale current of the current source, the capacitor 260 is discharged down to the corresponding driving voltage level. When the voltage across the capacitor 260 is lower than the driving voltage level corresponding to the gray scale current of the current source, the capacitor 260 is charged up to the required driving voltage level.

Then the driving circuit proceeds to an illumination stage. At this time, the second switch 220 and the third switch 230 are turned off by the control signal $V_{S2}$, and the first switch 210 is turned on by the control signal $V_{S1}$ as shown in FIG. 5. Therefore, a current, which flows through the OLED 240 and the drain and the source of the driving thin film transistor 250, will be equal to the gray scale current of the current source due to the driving of the voltage across the capacitor 260.

Figure 4:
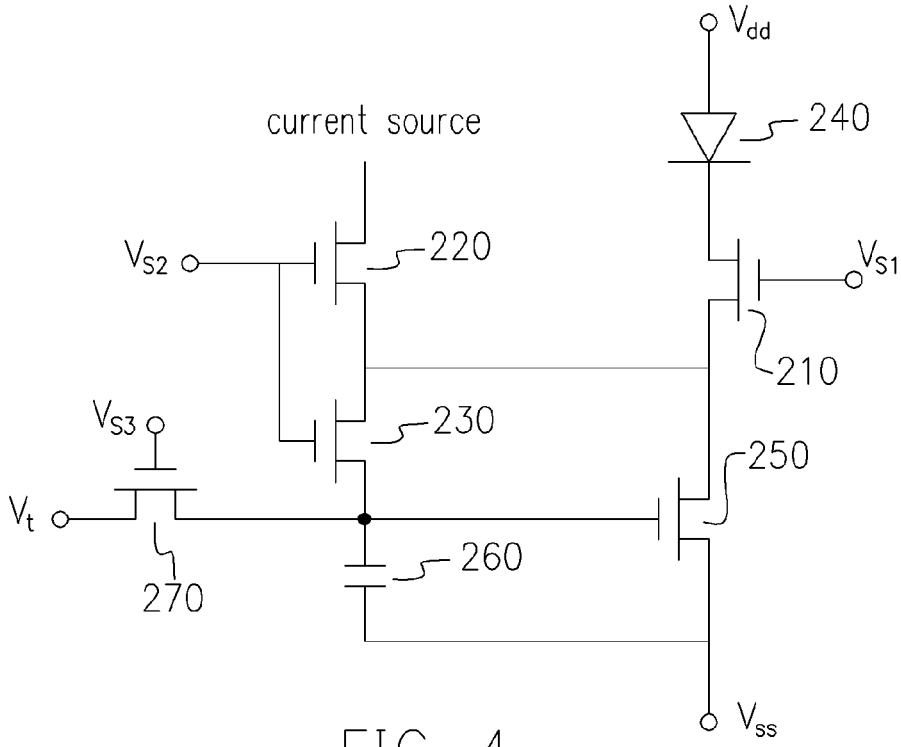
FIG. 4 is a driving circuit diagram of the current-driven AMOLED pixel of FIG. 3, in which N-channel thin film transistors are used as the switches.

The first switch 210, the second switch 220, the third switch 230 and the pre-charge switch 270 can be an N-channel or a P-channel thin film transistor. FIG. 4 shows the driving circuit of the AMOLED pixel in which N-channel thin film transistors are used as the switches 210, 220, 230 and 270. FIG. 5 is a timing diagram of control signals of the switches. Although a driving circuit of the AMOLED pixel in which P-channel thin film transistors are used as the switches is not shown, the skilled person can still understand easily its structure and operation process by referring to FIGS. 4 and 5.

Figure 6:
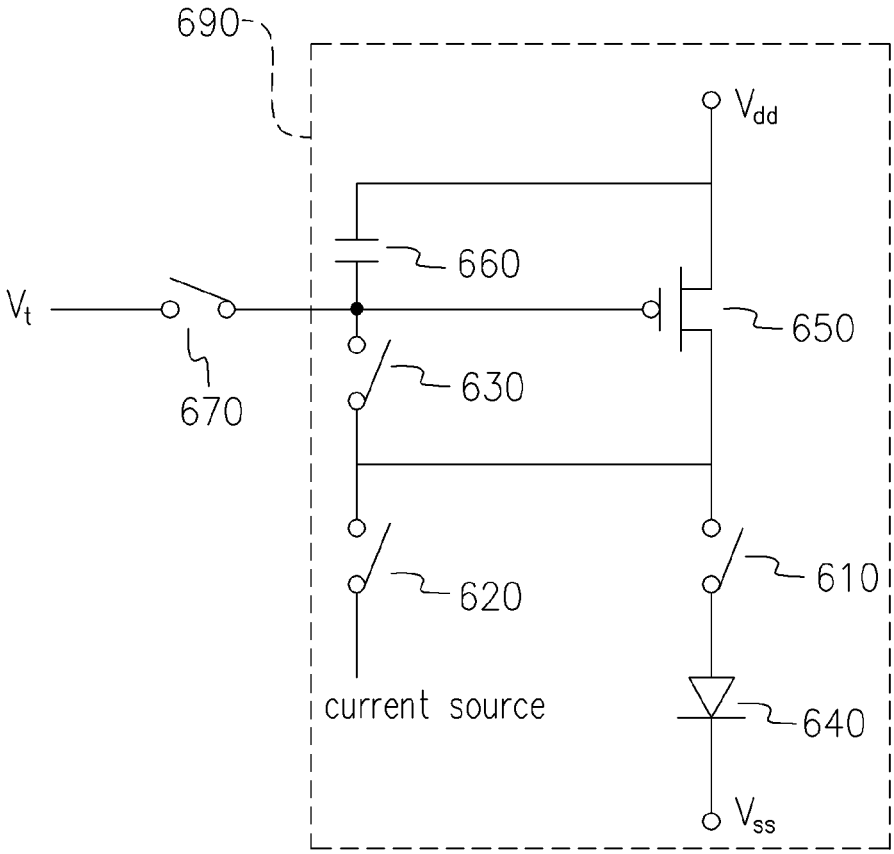
FIG. 6 shows an exemplary driving circuit diagram of a current-driven AMOLED pixel according to the second embodiment of the present invention.

FIG. 6 shows an exemplary driving circuit of a current-driven AMOLED pixel according to the second embodiment of the present invention. In FIG. 6, in addition to a P-channel thin film transistor being used to make a driving thin film transistor 650 of the driving circuit of the AMOLED pixel 690, the driving circuit comprises a pre-charge switch 670 connected to a driving power source Vt. The driving circuit further comprises a capacitor 660, an OLED 640, a first switch 610, a second switch 620 and a third switch 630. The OLED 640 has an anode and a cathode, wherein the cathode is connected to a negative power source Vss. One end of the first switch 610 is connected to the anode of the OLED 640, and another end of the first switch 610 is connected to the drain of the driving thin film transistor 650. One end of the second switch 620 is connected to a current source and another end of the second switch 620 is connected to the drain of the driving thin film transistor 650. On end of the third switch 630 is connected to the drain of the driving thin film transistor 650 and another end of the third switch 630 is connected to the gate of the driving thin film transistor 650 and one end of the capacitor 660. The other end of the capacitor 660 and the source of the driving thin film transistor 650 are connected to a positive power source Vdd.

The operation of the driving circuit of the second embodiment is descried as follows. The pre-charge switch 670 is first turned on by the control signal $V_{S3}$, so that the driving power source Vt is able to pre-charge the capacitor 660 to a pre-charge voltage level before the current source charges or discharges the capacitor 660. Preferably, the pre-charge voltage level is close to a level of the threshold voltage of the driving thin film transistor 650. In this way, when the current source charges or discharges the capacitor 660, a voltage across the capacitor 660 can be fast stabilized to a driving voltage level corresponding to a gray-scale current of the current source. If the number of wires and power sources of the driving circuit are required to be reduced, the negative power source Vss of the driving circuit can be used as the driving power source Vt to pre-charge the capacitor 660 to the pre-charge voltage level.

After the pre-charge a driving voltage adjustment stage is proceeded. At this time, the pre-charge switch 670 is turned off by the control signal $V_{S3}$, and the second switch 620 and the third switch 630 are turned on by the control signal $V_{S2}$, so that the voltage across the capacitor 660 can be fast adjusted to a driving voltage level corresponding to a gray scale current of the current source. Namely, when the voltage across the capacitor 660 is higher than the driving voltage level corresponding to the gray scale current of the current source, the capacitor 660 is discharged down to the corresponding driving voltage level. When the voltage across the capacitor 660 is lower than the driving voltage level corresponding to the gray scale current of the current source, the capacitor 660 is charged up to the required driving voltage level.

Then, the driving circuit proceeds to an illumination stage. At this time, the second switch 620 and the third switch 630 are turned off by the control signal $V_{S2}$, and the first switch 610 is turned on by the control signal $V_{S1}$. Therefore, a current, which flows through the OLED 640 and the drain and the source of the driving thin film transistor 650, will be equal to the gray scale current of the current source due to the driving of the voltage across the capacitor 660.

Figure 7:
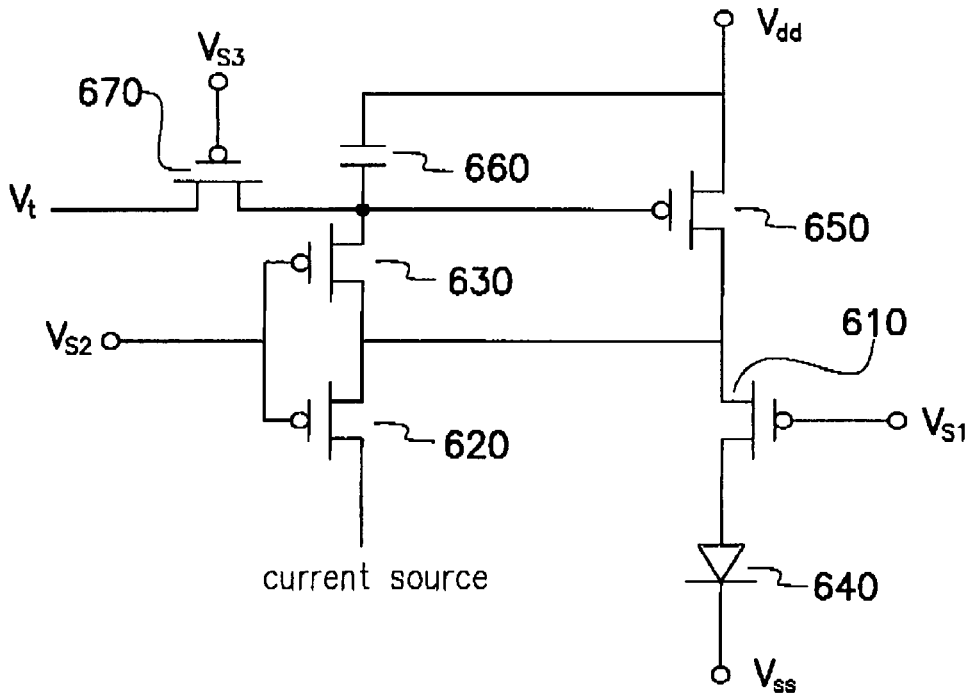
FIG. 7 is a driving circuit diagram of the current-driven AMOLED pixel of FIG. 6, in which P-channel thin film transistors are used as the switches.

Similarly, the first switch 610, the second switch 620, the third switch 630 and the pre-charge switch 670 can be a P-channel or an N-channel thin film transistor. FIG. 7 shows the driving circuit of the AMOLED pixel in which P-channel thin film transistors are used as the switches 610, 620, 630 and 670. FIG. 5 is a timing diagram of control signals of the switches. Although a driving circuit of the AMOLED pixel in which N-channel thin film transistors are used as the switches is not shown, the skilled person can still understand easily its structure and operation process by referring to FIGS. 7 and 5.

Figure 8:
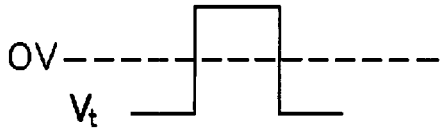
FIG. 8 is an exemplary waveform of the driving power source Vt in FIG. 3.

Furthermore, in order to improve the threshold voltage of the driving thin film transistor drifting with the operation time, a driving power source with different voltages can be used. FIG. 8 is an exemplary waveform of the driving power source Vt in FIG. 3. Referring to FIG. 8, a positive voltage portion of the waveform, which can pre-charge the capacitor to a voltage close to the threshold voltage of the driving thin film transistor 250, is used during the pre-charge stage. Alternatively, a negative voltage portion of the waveform, which is opposite to the pre-charge polarity, is used during other than the pre-charge stage, so as to eject charges trapped within a gate insulating layer of the driving thin film transistor 250.

As described above, a driving method of a current-driven AMOLED can be concluded. An AMOLED pixel is connected to a current source and a driving power source for charging or discharging a capacitor connected to a gate of a driving thin film transistor of the AMOLED pixel. The driving method comprises steps of: pre-charging the capacitor by using the driving power source; adjusting a gray-scale charging voltage of the capacitor by using the current source; and stopping charging or discharging the capacitor through the current source to control the AMOLED pixel to enter an illumination stage.

In the aforementioned method, the driving power source can pre-charge the capacitor to a voltage close to the threshold voltage of thin film transistor. Alternatively, a driving power source with two different voltages can be also used.

While the present invention has been described with a preferred embodiment, this description is not intended to limit the present invention. Various modifications of the embodiment will be apparent to those skilled in the art. It is therefore contemplated that the appended claims will cover any such modifications or embodiments as fall within the scope of the present invention.

The invention claimed is:

1. A current-driven active matrix organic light emitting diode pixel (AMOLED pixel), comprising:

an organic light emitting diode (OLED) having an anode and a cathode directly connected to a negative power source;

a driving thin film transistor;

a capacitor having a first end directly connected to a gate of the driving thin film transistor and a second end directly connected to a positive power source;

a first switch having a first end directly connected to the anode of the OLED, a second end directly connected to a drain of the driving thin film transistor, and a control end directly receiving a first control signal;

a second switch having a first end directly connected to a current source, a second end directly connected to the drain of the driving thin film transistor and the second end of the first switch, and a control end directly receiving a second control signal;

a third switch having a first end directly connected to the drain of the driving thin film transistor and the second end of the first switch, a second end directly connected to the gate of the driving thin film transistor and the first end of the capacitor, and a control end directly connected to the control end of the second switch for directly receiving the second control signal; and a pre-charge switch having a first end directly receiving a driving power source, a second end directly connected to the gate of the driving thin film transistor, the first end of the capacitor and the second end of the third switch, and a control end directly receiving a third control signal, wherein the pre-charge switch is first turned on by the third control signal so as to make the driving power source pre-charge the capacitor to a pre-charge voltage level before the current source charges or discharges the capacitor, and thus making the driving thin film transistor have turned on when the current source charges or discharges the capacitor, the second and the third switches are turned on by the second control signal after the pre-charge switch is turned off by the third control signal, and the first switch is turned on by the first control signal after the second and the third switches are turned off by the second control signal.

2. The current-driven AMOLED pixel of claim 1, wherein each of the first switch, the second switch, the third switch, the driving thin film transistor, and the pre-charge switch is a P-channel thin film transistor.

3. The current-driven AMOLED pixel of claim 1, wherein each of the first switch, the second switch, the third switch, the driving thin film transistor, and the pre-charge switch is an N-channel thin film transistor.

4. The current-driven AMOLED pixel of claim 1, wherein the driving power source is a negative power source.

5. The current-driven AMOLED pixel of claim 1, wherein the driving power source comprises two different voltage levels.

6. A current-driven active matrix organic light emitting diode pixel (AMOLED pixel), comprising:

an organic light emitting diode (OLED) having an anode and a cathode directly connected to a negative power source;

a driving thin film transistor;

a capacitor having a first end directly connected to a gate of the driving thin film transistor and a second end directly connected to a positive power source;

a first switch having a first end directly connected to the anode of the OLED, a second end directly connected to a drain of the driving thin film transistor, and a control end directly receiving a first control signal;

a second switch having a first end directly connected to a current source, a second end directly connected to the drain of the driving thin film transistor and the second end of the first switch, and a control end directly receiving a second control signal;

a third switch having a first end directly connected to the drain of the driving thin film transistor and the second end of the first switch, a second end directly connected to the gate of the driving thin film transistor and the first end of the capacitor, and a control end directly connected to the control end of the second switch for directly receiving the second control signal; and a pre-charge switch having a first end directly receiving a driving power source, a second end directly connected to the gate of the driving thin film transistor, the first end of the capacitor and the second end of the third switch, and a control end directly receiving a third control signal.

* * * * *